US010538978B1

(12) United States Patent
Du

(10) Patent No.: US 10,538,978 B1
(45) Date of Patent: Jan. 21, 2020

(54) WASHPIPE SEAL ASSEMBLY

(71) Applicant: CLARK SEALS, LTD., Tulsa, OK (US)

(72) Inventor: Lei Du, Tulsa, OK (US)

(73) Assignee: CLARK SEALS, LTD., Tulsa, OK (US)

( * ) Notice: Subject to any disclaimer, the term of this patent is extended or adjusted under 35 U.S.C. 154(b) by 12 days.

(21) Appl. No.: 15/656,743

(22) Filed: Jul. 21, 2017

(51) Int. Cl.
*E21B 21/02* (2006.01)
*E21B 33/04* (2006.01)
*E21B 33/00* (2006.01)

(52) U.S. Cl.
CPC ..... *E21B 21/02* (2013.01); *E21B 33/0415* (2013.01); *E21B 2033/005* (2013.01)

(58) Field of Classification Search
CPC ..... E21B 21/02; E21B 33/0415; E21B 2033/005; E21B 33/0422; E21B 33/043; E21B 33/0407; E21B 33/047; E21B 33/00; F16L 31/00; F16L 33/00
USPC ..... 277/322
See application file for complete search history.

(56) References Cited

U.S. PATENT DOCUMENTS 2,998,987 A 9/1961 Taschenberg et al.
3,210,087 A 10/1965 Mayer
4,367,795 A 1/1983 Biffle
5,695,197 A 12/1997 Farley et al.
6,334,619 B1 1/2002 Dietle et al.
6,422,570 B2 7/2002 Ikeda et al.
6,454,237 B1 * 9/2002 VanDeVyvere ..... F16K 27/07 137/102
6,923,254 B2 * 8/2005 Morrow ..... E21B 17/05 166/88.4
7,213,660 B2 * 5/2007 Martin ..... E21B 21/02 166/78.1
7,343,968 B2 3/2008 Kubala
7,350,588 B2 4/2008 Abercrombie Simpson et al.
7,789,161 B2 9/2010 Riley et al.
8,225,858 B2 7/2012 Martin
2004/0245727 A1 * 12/2004 Bunn ..... F16J 15/006 277/500
2005/0206090 A1 * 9/2005 Bunn ..... F16J 15/006 277/549
2013/0299238 A1 * 11/2013 Weaver ..... G01M 3/02 175/40

* cited by examiner

*Primary Examiner* — Nathan Cumar
(74) *Attorney, Agent, or Firm* — James F. Lea, III; Gable Gotwals

(57) ABSTRACT

A high pressure seal assembly for connection to an upper and lower connector pipe. The seal assembly includes a lower seal assembly surrounding a lower end of a rotating pipe, e.g., a washpipe. The lower seal assembly includes a first and second seal ring that define an annular space. The seal rings have a simple cross-section and are identical, thereby facilitating ease of manufacture and assembly. High pressure seals are received within annular spaces of the respective seal rings. The high pressure seals define inner surfaces that have a layer of self-lubricating polymer for engaging the rotating pipe. The high pressure seals define a pressure facing cavity that receives a high pressure ring that mitigates the spreading of the body of the high pressure seals due to pressure and that prevents the seal from extruding through an adjacent gap. An excluder seal prevents debris from entering the seal assembly.

40 Claims, 6 Drawing Sheets

WASHPIPE SEAL ASSEMBLY

FIELD OF THE INVENTION

The invention relates to high pressure seals. More particularly, the invention relates to high pressure seals for washpipes.

BACKGROUND OF THE INVENTION

In a drilling system, high pressure fluids are sent down the bore hole through a washpipe and a drill string, and ultimately to a drill motor at the bottom of the drill string. The fluid is supplied to the motor for driving cutting tools under very high pressure. A seal is necessary at the joint between the non-rotary upper connection assembly and the rotary lower connection assembly to prevent leakage of the drilling fluid to the outside. The joint is between the upper connection assembly, which includes a housing for the stator assembly, and the lower connection assembly, which includes the rotor assembly that is affixed to and rotates with the drill string. The rotor and housing are sometimes collectively referred to as a "cartridge." The seal for this joint is referred to as a washpipe seal.

A typical wash pipe seal assembly is shown in FIG. 1. Note that the prior art seal is housed in a lower packing nut and includes three elastomeric v-ring seals mounted on heavily machined and shaped bronze rings. The top bronze ring is ported to facilitate greasing of the seal assembly. The middle bronze ring is un-ported. The lower bronze ring defines an O-ring receptacle. Each of the bronze rings are stacked face-to-face, which define leak paths. Disadvantages of the prior art seal assembly include the potential for easy damage or deformation of the bronze rings, the existence of a leak path between adjacent rings, complex machining requirements, different bronze ring configurations that require a correct stacking order, and difficulties associated with dispersing grease evenly to each of the three elastomeric v-ring seals. If too little grease is provided, then the v-ring seals are prone to early failure. If too much grease is provided, then grease may get into the mud, which may affect mud circulation.

Still referring to FIG. 1, i.e., to the prior art seal configuration, an elastomeric v-ring seal is located in a shaped ring and is received in a receptacle defined by the upper packing nut. One disadvantage associated with the prior art seal relates to the gap between the upper packing nut and the pipe. In particular, the gap can allow for the v-ring seal to be pushed into and through the gap when the seal assembly is subjected to high pressures.

In greater detail, still referring to FIG. 1, shown is prior art washpipe seal assembly 10 for connection to an upper static connector pipe or gooseneck and a dynamic lower connector pipe or shaft 14. Prior art washpipe seal assembly 10 includes washpipe 16.

A static upper seal assembly 30 surrounds upper end of washpipe 16. Static upper seal assembly 30 includes upper packing nut 32. A lower end of upper packing nut 32 defines angular recess 42 on an inside surface. Upper ring 50 is received within upper packing nut 32. Upper ring 50 has an upper surface 52 defining an annular seal receptacle for receiving seal 58.

Upper elastomeric v-ring seal 60 is located within an annular space defined by upper ring 50 and washpipe 16. Upper elastomeric v-ring seal 60 has an inner surface 62 for engaging washpipe 16. Upper elastomeric v-ring seal 60 additionally includes a lower protrusion that is received within annular recess 42.

A dynamic lower seal assembly designated generally 70 surrounds a lower end of washpipe 16. Dynamic lower seal assembly includes lower packing nut 72. Lower packing nut 72 defines vertical wall 78 that connects an upper end and a lower end. Lower packing nut 72 additionally defines grease port 86 on vertical wall 78.

First elastomeric v-ring seal 90 defines an upper protrusion received within annular recess 82 defined by an upper end of lower packing nut 72. First elastomeric v-ring seal 90 has a downwardly protruding inside seal portion for communicating with washpipe 16 and has a downwardly protruding outside seal portion.

A first bronze spacer ring 100 is located below first elastomeric v-ring seal 90. First bronze spacer ring 100 has a vertical portion that extends between downwardly protruding outside seal portion of first elastomeric v-ring 90 and an inside surface of vertical wall 78 of lower packing nut 72. First bronze spacer ring 100 defines a horizontal portion that defines grease passageway 108 for delivering grease from grease port 86 to an area adjacent washpipe 16.

A second elastomeric v-ring seal 110 has an upper protrusion received within an annular recess of first bronze spacer ring 100. Second elastomeric v-ring seal 110 has a downwardly protruding inside seal portion for communicating with washpipe 16. Second elastomeric v-ring seal 110 also has a downwardly protruding outside seal section.

A second bronze spacer ring 120 is located below second elastomeric v-ring seal 110. Second bronze spacer ring 120 has a vertical portion between the downwardly protruding outside seal portion of second elastomeric v-ring 110 and an inside surface of vertical wall 78 of lower packing nut 72. A lower surface of a horizontal portion of second bronze ring 120 defines an annular recess. An upper surface of the horizontal portion is in sealing engagement with a lower end of the downwardly protruding outside seal portion of second elastomeric v-ring seal 110.

A third elastomeric v-ring seal 130 has an upper protrusion received within the annular recess of second bronze spacer ring 120. Third elastomeric v-ring seal 130 has a downwardly protruding inside seal portion for communicating with washpipe 16. Third elastomeric v-ring seal 130 additionally has a downwardly protruding outside seal portion.

A third bronze spacer ring 140 is located below third elastomeric v-ring seal 130. Third bronze spacer ring 140 has a vertical portion between the downwardly protruding outside seal portion of third elastomeric v-ring seal 130 and an inside surface of vertical wall 78 of lower packing nut 72. Third bronze spacer ring 140 defines a horizontal portion. A lower surface of the horizontal portion defines an annular seal receptacle 146 for receiving seal 150.

SUMMARY OF THE INVENTION

The high pressure seal assembly of the disclosure includes a lower seal assembly and an upper seal assembly, wherein the high pressure seal assembly is designed to withstand exceptionally high pressures, such as 10,000 to even 15,000 psi. Applicant's high pressure seal assembly may replace, via a retrofit, seal assemblies that are typically found in the field.

In one embodiment, the seal assembly of the disclosure includes a high pressure seal, e.g., a Viton D90 ring with a PTFE sealing surface located in a steel ring having a simple cross-section. Identical rings and seals are stacked three high, which simplifies assembly as compared to the differently shaped first, second, and third elastomeric v-ring seals and bronze spacer rings of the prior art. The high pressure seal of the disclosure has a self-lubricating polymer inner surface, such as PTFE or Teflon that eliminates difficulties associated with greasing the seal assembly through a grease port. Difficulties associated with greasing a seal assembly through a grease port include underfilling or overfilling the seal assembly with grease and uneven grease distribution. The high pressure elastomeric seal that is received within a ring defines an inner leg for contacting a washpipe and defines an outer leg in contact with the ring. The inner leg, outer leg, and seal base define a seal cavity. A seal insert ring, such as an o-ring, is received within the seal cavity for directing pressure process toward the seal base for mitigating a spreading force that may otherwise act on the elastomeric seal. Directing pressure towards the seal base decreases the possibility of the seal being forced through a gap between the ring and washpipe. All adjacent ring surfaces are provided with O-rings to prevent a leak path. Additionally, an excluder seal is provided above the 3-ring stack to prevent an ingress of particulates into the seal assembly.

Advantages of the seal assembly of the disclosure include an assembly having identical components, a self-lubricating seal face to avoid difficulties associated with applying grease through a grease port, simply shaped steel rings that are more durable than bronze and that are easily machined, seals between adjacent rings, the addition of an excluder seal, and a specially shaped high pressure elastomeric seal with integral o-ring for avoiding seal extrusion.

The upper seal assembly utilizes an identical seal to the seal used in the lower seal assembly described above, except that the seal is inverted for use in the upper seal assembly. Applicant's upper seal assembly utilizes an annular plate to provide a floor for supporting the seal and for covering the v-shaped indentation provided in the upper packing nut to receive prior art v-rings.

Advantages of Applicant's assembly further include utilizing the same high pressure ring and seal assembly for the upper seal assembly and for the lower seal assembly to facilitate ease of manufacture and assembly.

Because Teflon is easily damaged when a pipe is located within the seal assembly, an installation tool may be employed. The installation tool is sized to be tightly received within the upper seal assembly. The installation tool defines a frusto-conical protrusion for receiving within a lower end of the pipe. As the pipe is lowered onto the frustum, the pipe is centered within the upper seal assembly, thereby preventing any inadvertent contact between the potentially rough pipe end and the delicate Teflon seal surface. A sketch of the installation tool is provided on the attached figures.

DETAILED DESCRIPTION OF THE PREFERRED EMBODIMENTS

Figure 1:
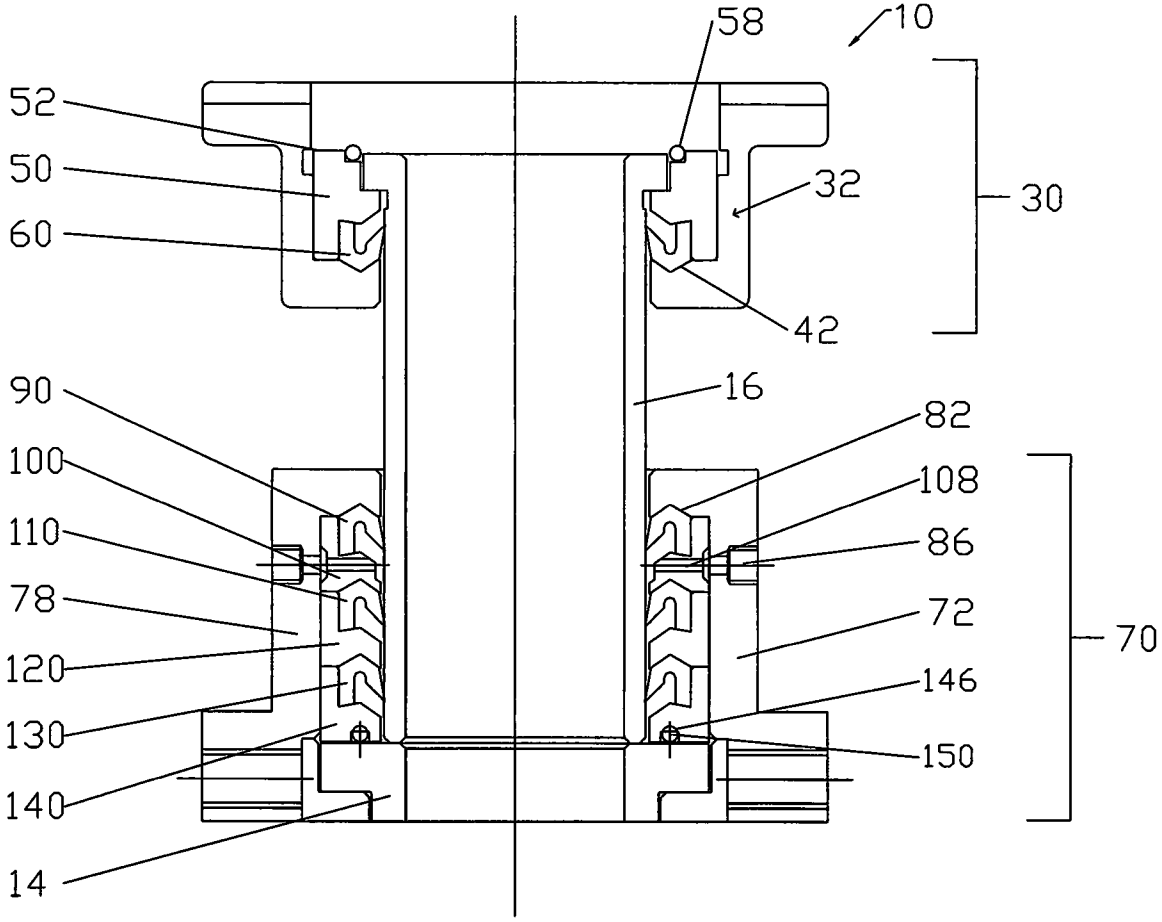
Fig 1 Prior Art
FIG. 1 is an elevation view of a prior art washpipe seal assembly.
Figure 2:
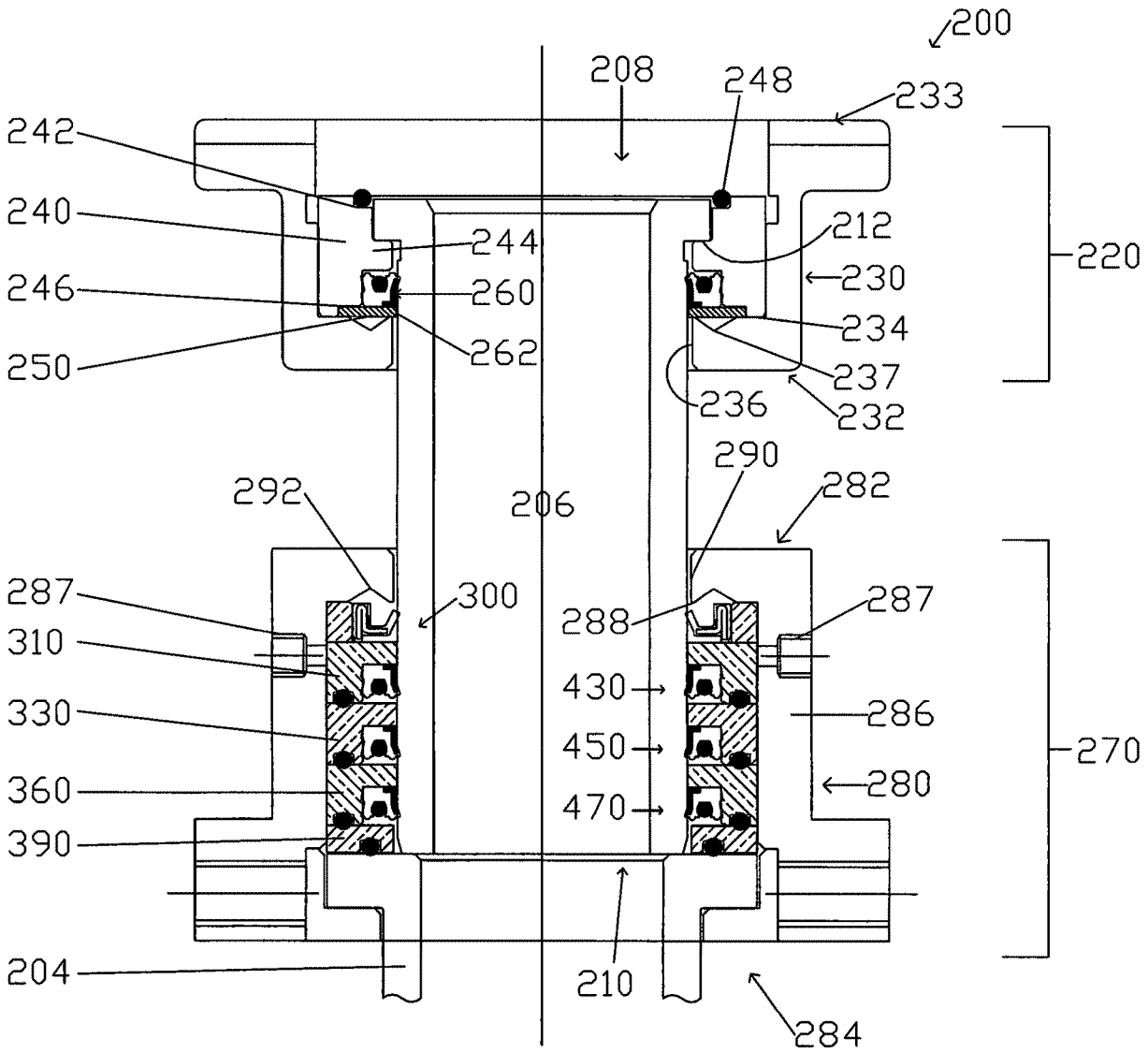
FIG. 2 is an elevation view of the washpipe seal of the disclosure.

Referring now to FIG. 2, shown is high pressure seal assembly 200 of the invention. High pressure seal assembly 200 may be used for connection to an upper static connector pipe or gooseneck and a dynamic lower connector pipe or shaft 204. In one embodiment, high pressure seal assembly 200 includes washpipe 206 defining upper end 208 and lower end 210. Upper end 208 defines a flange 212 having a lower surface.

Static upper seal assembly is designated generally 220 and surrounds upper end 208 of washpipe 206. Static upper seal assembly 220 includes upper packing nut 230 that defines lower end 232 and upper end 233. Lower end 232 has an inside surface 234. Lower end 232 defines upper seal washpipe orifice 236 for receiving washpipe 206. Inside surface 234 defines annular recess 237.

Upper seal ring 240 is received within upper packing nut 230. Upper seal ring 240 has an upper surface defining annular seal receptacle 242. Upper seal ring 240 also defines interior protrusion 244 having an upper surface and a lower surface. The upper surface of interior protrusion 244 mates with the lower surface of flange 212 of washpipe 206. Upper seal ring 240 has a lower surface defining plate indentation 246.

A seal, such as o-ring 248, is received in annular seal receptacle 242. O-ring 248 is provided for forming a seal between the upper surface of upper seal ring 240 and the gooseneck.

Annular plate 250 surrounds washpipe 206. Annular plate 250 is received within plate indentation 246 of upper ring 240 and covers annular recess 237 on inside surface 234 of lower end 232 of upper packing nut 230.

Figure 3:
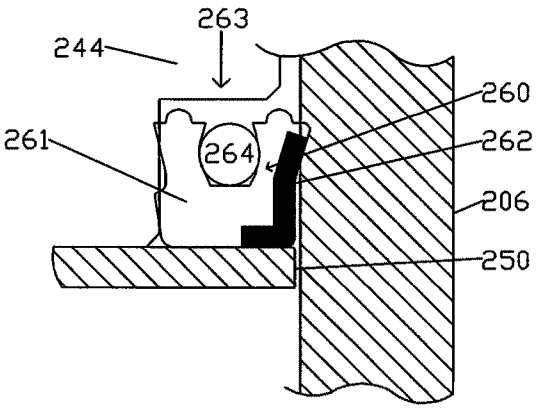
FIG. 3 is an enlarged view of the high pressure seal in the upper seal assembly of FIG. 2.
Figure 4:
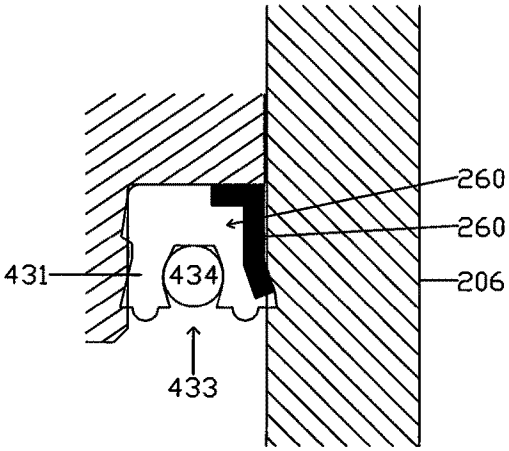
FIG. 4 is an enlarged view of the high pressure seal in the lower seal assembly of FIG. 2.

As shown in greater detail in FIG. 3, upper high pressure seal 260 is received within an annular space defined by the lower surface of interior protrusion 244 of upper seal ring 240, a vertical portion of upper seal ring 240, annular plate 250, and washpipe 206. As shown in greater detail in FIG. 3, upper high pressure seal 260 preferably includes a seal body 261, made of an elastomer such as Viton. An inner surface of high pressure seal 260 is provided with a self-lubricating polymer layer 262, which is preferably a layer of Teflon that is bonded to body 261 for engaging a rotating pipe, such as washpipe 206. Body 261 defines a pressure facing cavity 263. A high pressure ring 264, such as an o-ring, is received within the pressure facing cavity 263 of body 261.

Figure 5:
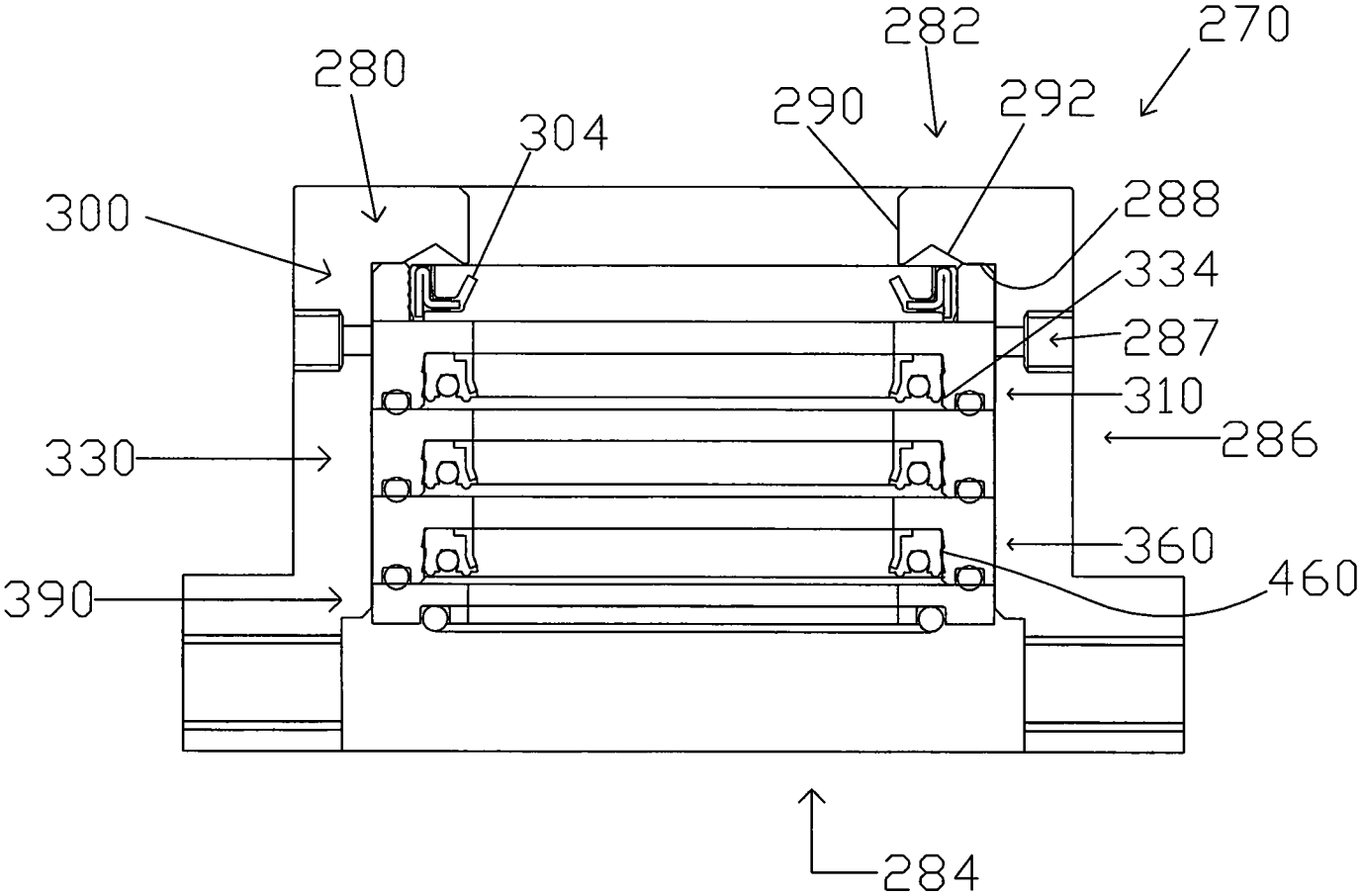
FIG. 5 is an enlarged elevation view of the lower seal assembly of the washpipe seal of FIG. 2.

Dynamic lower seal assembly is designated generally 270 (FIGS. 2 and 5). Lower seal assembly 270 surrounds lower end 210 of washpipe 206. Dynamic lower seal assembly 270 includes lower packing nut 280 defining an upper end 282, a lower end 284 and a vertical wall 286 that extends therebetween. Vertical wall 286 defines greasing holes 287. Upper end 282 has an inside surface 288. Upper end 282 defines a lower washpipe orifice 290 for receiving washpipe 206. Upper end 282 defines an annular recess 292 on inside surface 288.

Figure 6:
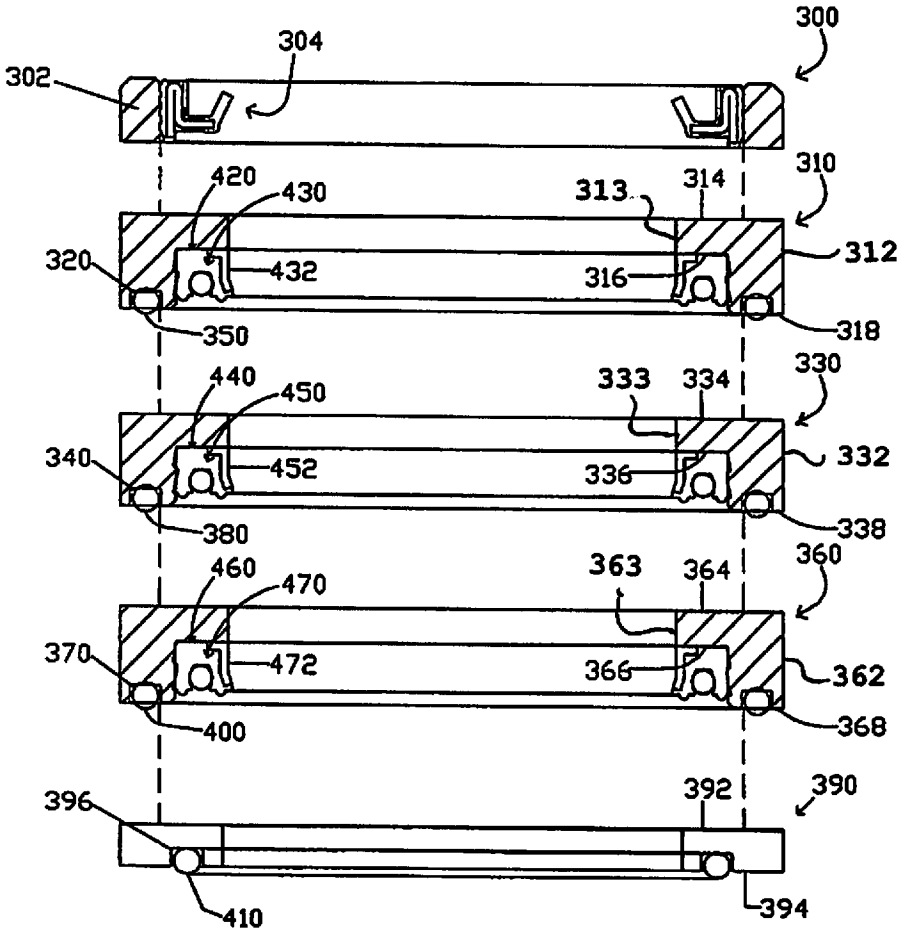
FIG. 6 is an exploded view of the seal rings in the lower seal assembly of FIGS. 2 and 4.

An excluder seal ring is designated generally 300 (FIGS. 2, 5, 6). Excluder seal ring 300 is adjacent to annular recess 292 of inside surface 288 of upper end 282 of lower packing nut 280. Excluder seal ring 300 has an outer ring 302 (FIG.

6) and an adjacent upwardly facing excluder member 304 (FIG. 6) biased against washpipe 206.

A first seal ring 310 (FIGS. 2, 3, 5) has an outside surface 312, an inner surface 313, an upper portion defining an upper surface 314 and an intermediate surface 316. First seal ring 310 has a lower surface 318 defining first seal receptacle 320. First seal ring 310 also has a vertical portion between intermediate surface 316 and lower surface 318.

Second seal ring 330 (FIGS. 2, 5, 6) has an upper portion defining an outside surface 332, an inner surface 333, an upper surface 334 and intermediate surface 336. Second seal ring 330 has a lower surface 338 defining a second seal receptacle 340. Second seal ring 330 has a vertical portion between intermediate surface 336 and lower surface 338.

First outer seal, such as first outer o-ring 350, is located in first seal receptacle 320 for sealing engagement between lower surface 318 of first ring 310 and upper surface 334 of second seal ring 330.

Third seal ring 360 (FIGS. 2, 5, 6) has an upper portion defining an outside surface 362, an inner surface 363, an upper surface 364 and intermediate surface 366. Third seal ring 360 has a lower surface 368 defining a third seal receptacle 370. Third seal ring 360 has a vertical portion between intermediate surface 366 and lower surface 368.

Second outer seal, such as second outer o-ring 380, is located in second seal receptacle 340 for sealing engagement between lower surface 338 of second ring 330 and upper surface 364 of third seal ring 360.

Lower ring 390 (FIGS. 2, 5, 6) has upper surface 392 and lower surface 394. Lower surface 394 of lower ring 390 defines base seal receptacle 396.

Third outer seal, such as third outer o-ring 400, is located in third seal receptacle 370 is for sealing engagement between lower surface 368 of third ring 360 and upper surface 392 of lower ring 390.

Fourth seal 410, such as fourth o-ring, is located in base ring receptacle 396 for sealing engagement between lower surface 394 of lower ring 390 and an upper surface of shaft 204.

A first annular space 420 is defined by intermediate surface 316 of first seal ring 310, the vertical portion of first ring 310, upper surface 334 of second seal ring 330, and washpipe 206.

A first high pressure seal 430 (FIGS. 2, 4, 5, 6) is received within first annular space 420. First high pressure seal 430 includes a seal body 431, such as Viton. Body 431 has an inner surface that is provided with a self-lubricating polymer layer 432, such as Teflon, that is bonded to seal body 431 for engaging a rotating pipe, such as washpipe 206. Body 431 defines a pressure facing cavity 433. A high pressure ring 434, such as an o-ring, is received within pressure facing cavity 433 of body 431.

A second annular space 440 is defined by intermediate surface 336 of second seal ring 330, the vertical portion of second seal ring 330, upper surface 364 or third seal ring 360, and washpipe 206.

A second high pressure seal 450 (FIGS. 2, 5, 6) is received within second annular space 440. Second high pressure seal 450 includes a seal body 451, such as Viton. Body 451 has an inner surface that is provided with a self-lubricating polymer layer 452, such as a layer of Teflon that is bonded to seal body 451, for engaging a rotating pipe, such as washpipe 206. Body 451 defines a pressure facing cavity 453. A high pressure ring 454, such as an o-ring, is received within pressure facing cavity 453 of body 451.

A third annular space 460 is defined by intermediate surface 366 of third seal ring 360, the vertical portion of third seal ring 360, the upper surface 392 of lower ring 390, and washpipe 206.

Third high pressure seal 470 (FIGS. 2, 5, 6) is received within third annular space 460. Third high pressure seal 470 includes a seal body 471, such as Viton. Body 471 has an inner surface that is provided with a self-lubricating polymer layer 472, such as a layer of Teflon that is bonded to seal body 451 for engaging a rotating pipe, such as washpipe 206. Body 471 defines a pressure facing cavity 473. A high pressure ring, 474, such as an o-ring, is received within pressure facing cavity 473 of body 471.

In a preferred embodiment, second seal ring 330 and third seal ring 360 have an identical construction to that of first seal ring 310, shown in an enlarged view of FIG. 5.

In practice, a user should apply grease under sealing lip 304 of excluder seal ring 300. The excluder seal ring 300 is installed in lower packing nut 280. Grease should be applied to inner diameter of seal rings 310, 330, and 360 as well as inner surfaces 262, 432, 452, and 472 of high pressure seals 260, 430, 450, and 470, respectively. Lower ring 390 is then located in lower packing nut 280. Greasing holes 287 should be blocked up.

Figure 7:
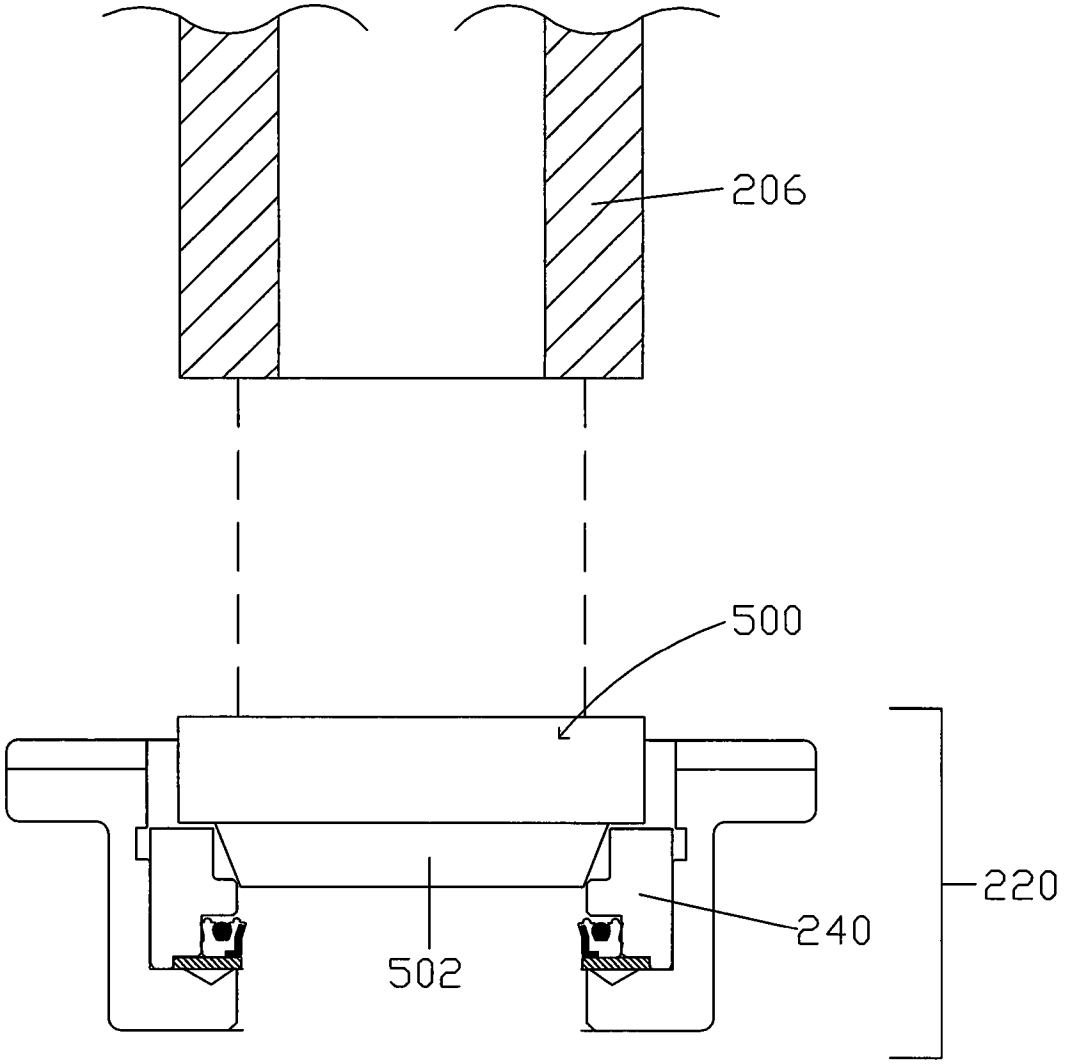
FIG. 7 is a cross-sectional elevation view of an installation tool for use with the washpipe seal assembly.

Referring now to FIG. 7, installation tool 500 may be placed within upper seal assembly 220. Installation tool 500 defines frusto-conical protrusion 502 for receiving a lower end of rotating pipe 206 for centering pipe 206 within upper seal assembly 220, thereby preventing inadvertent contact between the potentially rough end of pipe 206 and inner surface of high pressure seal 260.

Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the spirit of this invention as defined by the claims.

What is claimed is:

1. A seal assembly for connection to an upper connector pipe and a lower connector pipe, said seal assembly comprising:

a lower seal assembly for surrounding a lower end of a rotating pipe;

a first seal ring in said lower seal assembly, said first seal ring having an outside surface, an inner surface, and a lower surface, a first inwardly projecting structure comprising a first upper surface and a first intermediate surface;

a second seal ring in said lower seal assembly, said second seal ring defining an outside surface, an inner surface, and having an upper surface adjacent to said lower surface of first seal ring, said second seal ring having a lower surface and a second inwardly projecting structure comprising said upper surface and defining a second intermediate surface;

a third seal ring in said lower seal assembly, said third seal ring defining an outside surface, an inner surface, and having a third upper surface adjacent to said lower surface of said second seal ring, said third seal ring having a third inwardly projecting structure comprising said third upper surface and a third intermediate surface;

a first seal received adjacent to said first intermediate surface;

a second seal received adjacent to said second intermediate surface;

a third seal received adjacent said third intermediate surface;

wherein said first seal ring, said second seal ring, and said third seal ring are identical, thereby facilitating easy assembly of the lower seal assembly;

wherein said first seal ring defines no pathway from said outside surface to said inner surface of said first seal ring;

wherein said second seal ring defines no pathway from said outside surface to said inner surface of said second seal ring;

wherein said third seal ring defines no pathway from said outside surface to said inner surface of said third seal ring;

wherein a first outer seal is between said lower surface of said first seal ring and said upper surface of said second seal ring for preventing flow therebetween;

wherein a second outer seal is between said lower surface of said second seal ring and said upper surface of said third seal ring for preventing flow therebetween.

2. The seal assembly according to claim 1 wherein:

said first seal ring including said first seal;

said first seal has an elastomeric seal body defining an inner surface;

a layer of self-lubricating polymer affixed to said inner surface of said first seal for engaging said rotating pipe.

3. The seal assembly according to claim 1 wherein:

said first seal has a seal body that defines a pressure facing cavity; and a high pressure O-ring is located in said pressure facing cavity for mitigating spreading of said seal body due to pressure.

4. The seal assembly according to claim 1 further comprising:

a first outside seal between said first seal ring and said second seal ring, said first outside seal in contact with only said lower surface of said first seal ring and said upper surface of said second seal ring for sealing engagement between a lower surface of said first seal ring and an upper surface of said second seal ring.

5. The seal assembly according to claim 1 further comprising:

a lower ring between the lower connector pipe and a lowermost one of said first seal ring, said second seal ring, and said third seal ring;

wherein all of a surface of said lower ring facing said lowermost one is co-planar;

an outside seal between a lower surface of said lower ring and an upper surface of the lower connector pipe for sealing engagement between said lower surface of said lower ring and an upper surface of the lower connector pipe.

6. The seal assembly according to claim 1 further comprising:

an excluder seal assembly above said first seal ring, said excluder seal assembly having an outer ring and an adjacent excluder member having an innermost sealing member angled toward an upper end of the seal assembly, said innermost sealing member biased against said rotating pipe.

7. The seal assembly according to claim 1 further comprising:

an upper seal assembly for surrounding an upper end of said rotating pipe;

an upper seal ring in said upper seal assembly, said upper seal ring defining inwardly projecting structure;

an upper seal between said interior structure and above an annular plate, wherein said upper seal is identical to said first seal and said second seal.

8. The seal assembly according to claim 7 wherein:

said upper seal has an elastomeric seal body defining an inner surface;

a layer of self-lubricating polymer affixed to said inner surface of said upper seal for engaging said rotating pipe.

9. A seal assembly for connection to an upper connector pipe and a lower connector pipe, said seal assembly comprising:

a lower seal assembly surrounding a lower end of a rotating pipe, said lower seal assembly comprising:

a first seal ring including a first seal, said first seal having an elastomeric seal body defining an inner surface;

a second seal ring including a second seal, said second seal having an elastomeric seal body defining an inner surface, said second seal ring adjacent to said first seal ring;

a third seal ring including a third seal, said third seal having an elastomeric seal body defining an inner surface, said third seal ring adjacent said second seal ring;

wherein a layer of self-lubricating polymer is affixed to said inner surface of said first seal and a layer of self-lubricating polymer is affixed to said inner surface of said second seal, and a layer of self-lubricating polymer is affixed to said inner surface of said third seal for engaging said rotating pipe;

said first seal ring, said second seal ring, and said third seal ring are identical;

said first seal ring defines an inner surface, an outside surface, and a lower surface, said second seal ring defines an inner surface and an outside surface, and an upper surface, and a lower surface, and said third seal ring defines an inner surface, an outside surface, and an upper surface;

wherein said first seal ring defines no pathway from said outside surface to said inner surface of said first seal ring;

wherein said second seal ring defines no pathway from said outside surface to said inner surface of said second seal ring;

wherein said third seal ring defines no pathway from said outside surface to said inner surface of said third seal ring;

wherein a first outer seal is between said lower surface of said first seal ring and said upper surface of said second seal ring for preventing flow therebetween;

wherein a second outer seal is between said lower surface of said second seal ring and said upper surface of said third seal ring for preventing flow therebetween.

10. The seal assembly according to claim 9 wherein:

said seal body of said first seal defines a pressure facing cavity; and an O-ring is located in said pressure facing cavity for mitigating spreading of said seal body due to pressure.

11. The seal assembly according to claim 9 further comprising:

a first outside seal between said first seal ring and said second seal ring, said first outside seal in contact with only said lower surface of said first seal ring and said upper surface of said second seal ring for sealing engagement between a lower surface of said first seal ring and an upper surface of said second seal ring.

12. The seal assembly according to claim 9 further comprising:

a lower ring beneath said second seal ring.

13. The seal assembly according to claim 12 further comprising:

an outside seal between a lower surface of said lower ring and an upper surface of the lower connector pipe for sealing engagement between said lower surface of said lower ring and an upper surface of the lower connector pipe.

14. The seal assembly according to claim 9 further comprising:

an excluder seal assembly above said first seal ring, said excluder seal assembly having an outer ring and an adjacent excluder member having an innermost sealing member angled toward an upper end of the seal assembly, said innermost sealing member biased against said rotating pipe.

15. The seal assembly according to claim 9 further comprising:

an upper seal assembly for surrounding an upper end of said rotating pipe;

an upper seal ring in said upper seal assembly, said upper seal ring including an upper seal, wherein said upper seal is identical to said first seal and said second seal.

16. The seal assembly according to claim 9 further comprising:

an upper packing nut surrounding said upper seal assembly, said upper packing nut defining a lower end and an upper end, said lower end having an inside surface, said lower end defining an upper orifice for receiving said rotating pipe, said lower end defining an annular recess on said inside surface of said lower end;

an annular plate received within said upper packing nut and surrounding said rotating pipe, said annular plate covering said annular recess on said inside surface of said lower end of said upper packing nut.

17. A seal assembly for connection to an upper connector pipe and a lower connector pipe, said seal assembly comprising:

a lower seal assembly surrounding a lower end of a rotating pipe, said lower seal assembly comprising:

a first seal ring having an upper portion defining an upper surface, a lower surface and a first annular space;

a second seal ring having an upper portion defining an upper surface, a lower surface and a second annular space;

a first outside seal between said first seal ring and said second seal ring, said first outside seal in contact with only said lower surface of said first seal ring and said upper surface of said second seal ring for sealing engagement between said lower surface of said first seal ring and said upper surface of said second seal ring;

a first seal received within said first annular space, said first seal having an inner surface for engaging said rotating pipe;

a second seal received within said second annular space, said second seal having an inner surface for engaging said rotating pipe.

18. The seal assembly according to claim 17, further comprising:

a third seal ring adjacent to said second seal ring, said third seal ring including a third seal having an elastomeric seal body; and wherein said first seal ring, said second seal ring, and said third seal ring are identical, thereby facilitating easy assembly of the lower seal assembly;

said first seal ring defines an inner surface and an outside surface, said second seal ring defines an inner surface, an outside surface, an upper surface and a lower surface, and said third seal ring defines an inner surface, an outside surface, and an upper surface;

wherein said first seal ring defines no pathway from said outside surface to said inner surface of said first seal ring;

wherein said second seal ring defines no pathway from said outside surface to said inner surface of said second seal ring;

wherein said third seal ring defines no pathway from said outside surface to said inner surface of said third seal ring;

wherein a first outer seal is between said lower surface of said first seal ring and said upper surface of said second seal ring for preventing flow therebetween;

wherein a second outer seal is between said lower surface of said second seal ring and said upper surface of said third seal ring for preventing flow therebetween.

19. The seal assembly according to claim 17 wherein:

said first seal ring including said first seal;

said first seal has an elastomeric seal body defining an inner surface;

a layer of self-lubricating polymer affixed to said inner surface of said first seal for engaging said rotating pipe.

20. The seal assembly according to claim 17 wherein:

said first seal has a seal body that defines a pressure facing cavity; and an O-ring is located in said pressure facing cavity for mitigating spreading of said seal body due to pressure.

21. The seal assembly according to claim 17 further comprising:

a lower ring beneath said second seal ring.

22. The seal assembly according to claim 21 further comprising:

an outside seal between a lower surface of said lower ring and an upper surface of the lower connector pipe for sealing engagement between said lower surface of said lower ring and said upper surface of the lower connector pipe.

23. The seal assembly according to claim 17 further comprising:

an excluder seal assembly above said first seal ring, said excluder seal assembly having an outer ring and an adjacent upwardly facing excluder member biased against said rotating pipe.

24. The seal assembly according to claim 17 further comprising:

an upper seal assembly for surrounding an upper end of said rotating pipe;

an upper seal ring in said upper seal assembly including an upper seal, wherein said upper seal is identical to said first seal and said second seal.

25. The seal assembly according to claim 24 wherein:

said upper seal has a seal body defining an inner surface;

said inner surface having a layer of self-lubricating polymer for engaging said rotating pipe.

26. The seal assembly according to claim 24 further comprising:

an upper packing nut surrounding said upper seal assembly, said upper packing nut defining a lower end and an upper end, said lower end having an inside surface, said lower end defining an upper orifice for receiving said rotating pipe, said lower end defining an annular recess on said inside surface of said lower end;

an annular plate received within said upper packing nut and surrounding said rotating pipe, said annular plate covering said annular recess on said inside surface of said lower end of said upper packing nut.

27. The seal assembly according to claim 17 wherein:

said first outside seal is received in a groove in said first seal ring for sealing engagement between said lower surface of said first seal ring and said upper surface of said second seal ring.

28. A seal assembly for connection to an upper connector pipe and a lower connector pipe, said seal assembly comprising:

a lower seal assembly for surrounding a lower end of a rotating pipe;

a first seal ring in said lower seal assembly, said first seal ring including a first seal;

a second seal ring in said lower seal assembly, said second seal ring adjacent to said first seal ring, said second seal ring including a second seal;

said first seal has a seal body that defines a pressure facing cavity; and an O-ring is located in said pressure facing cavity for mitigating spreading of said seal body due to pressure;

a lower ring between the lower connector pipe and a lowermost one of said first seal ring and said second seal ring;

wherein all of a surface of said lower ring facing said lowermost one is co-planar;

an outside seal between a lower surface of said lower ring and an upper surface of the lower connecter pipe for sealing engagement between said lower surface of said lower ring and an upper surface of the lower connector pipe.

29. The seal assembly according to claim 28 further comprising:

a third seal ring adjacent to said second seal ring, said third seal ring including a third seal having an elastomeric seal body; and wherein said first seal ring, said second seal ring, and said third seal ring are identical, thereby facilitating easy assembly of the lower seal assembly.

30. The seal assembly according to claim 28 further comprising:

said third seal ring adjacent to said second seal ring, said third seal ring including a third seal having an elastomeric seal body; and wherein said first seal ring, said second seal ring, and said third seal ring are identical;

said first seal ring defines an inner surface, an outside surface, and a lower surface, said second seal ring defines an inner surface, an outside surface, an upper surface and a lower surface, and said third seal ring defines an inner surface, an outside surface, and an upper surface;

wherein said first seal ring defines no pathway from said outside surface to said inner surface of said first seal ring;

wherein said second seal ring defines no pathway from said outside surface to said inner surface of said second seal ring;

wherein said third seal ring defines no pathway from said outside surface to said inner surface of said third seal ring;

wherein a first outer seal is between said lower surface of said first seal ring and said upper surface of said second seal ring for preventing flow therebetween;

wherein a second outer seal is between said lower surface of said second seal ring and said upper surface of said third seal ring for preventing flow therebetween.

31. The seal assembly according to claim 28 wherein:

said first seal ring includes a first seal, said first seal has an elastomeric seal body defining an inner surface;

a layer of self-lubricating polymer affixed to said inner surface of said first seal for engaging said rotating pipe.

32. The seal assembly according to claim 28 further comprising:

a first outside seal between said first seal ring and said second seal ring, said first outside seal for sealing engagement between a lower surface of said first seal ring and an upper surface of said second seal ring;

a lower ring beneath said second seal ring.

33. The seal assembly according to claim 32 further comprising:

an outside seal between a lower surface of said lower ring and an upper surface of the lower connector pipe for sealing engagement between said lower surface of said lower ring and an upper surface of the lower connector pipe.

34. The seal assembly according to claim 28 further comprising:

an excluder seal assembly above said first seal ring, said excluder seal assembly having an outer ring and an adjacent excluder member having an innermost sealing member angled toward an upper end of the seal assembly, said innermost sealing member biased against said rotating pipe.

35. The seal assembly according to claim 28 further comprising:

an upper seal assembly for surrounding an upper end of said rotating pipe;

an upper seal ring in said upper seal assembly, said upper seal ring including an upper seal in said annular space, wherein said upper seal is identical to said first seal and said second seal.

36. The seal assembly according to claim 35 wherein:

said upper seal ring includes a first seal, said first seal has an elastomeric seal body defining an inner surface;

a layer of self-lubricating polymer affixed to said inner surface of said first seal for engaging said rotating pipe.

37. The seal assembly according to claim 35 further comprising:

an upper packing nut surrounding said upper seal assembly, said upper packing nut defining a lower end and an upper end, said lower end having an inside surface, said lower end defining an upper orifice for receiving said rotating pipe, said lower end defining an annular recess on said inside surface of said lower end.

38. A seal assembly for connection to an upper connector pipe and a lower connector pipe, said seal assembly comprising:

a lower seal assembly for surrounding a lower end of a rotating pipe;

a first seal ring in said lower seal assembly, said first seal ring having a first inwardly projecting structure defining a first upper surface and a first intermediate surface;

a second seal ring in said lower seal assembly, said second seal ring adjacent to said first seal ring, said second seal ring having a second inwardly projecting structure defining a second upper surface and a second intermediate surface;

a third seal ring in said lower seal assembly, said third seal ring adjacent to said second seal ring, said third seal ring having a third inwardly projecting structure defining a third upper surface and a third intermediate surface;

a first seal received adjacent to said first intermediate surface;

a second seal received adjacent to said second intermediate surface;

a third seal received adjacent said third intermediate surface;

wherein said first seal ring, said second seal ring, and said third seal ring are identical, thereby facilitating easy assembly of the lower seal assembly;

a lower ring between the lower connector pipe and a lowermost one of said first seal ring, said second seal ring, and said third seal ring;

wherein all of a surface of said lower ring facing said lowermost one is co-planar;

an outside seal between a lower surface of said lower ring and an upper surface of the lower connector pipe for sealing engagement between said lower surface of said lower ring and an upper surface of the lower connector pipe.

39. A seal assembly for connection to an upper connector pipe and a lower connector pipe, said seal assembly comprising:

a lower seal assembly surrounding a lower end of a rotating pipe, said lower seal assembly comprising:

a first seal ring including a first seal, said first seal having an elastomeric seal body defining an inner surface;

a second seal ring including a second seal, said second seal having an elastomeric seal body defining an inner surface, said second seal ring adjacent to said first seal ring;

wherein a layer of self-lubricating polymer is affixed to said inner surface of said first seal and a layer of self-lubricating polymer is affixed to said inner surface of said second seal for engaging said rotating pipe;

a lower ring between the lower connector pipe and a lowermost one of said first seal ring, said second seal ring, and said third seal ring;

wherein all of a surface of said lower ring facing said lowermost one is co-planar;

an outside seal between a lower surface of said lower ring and an upper surface of the lower connector pipe for sealing engagement between said lower surface of said lower ring and an upper surface of the lower connector pipe.

40. A seal assembly for connection to an upper connector pipe and a lower connector pipe, said seal assembly comprising:

a lower seal assembly surrounding a lower end of a rotating pipe, said lower seal assembly comprising:

a first seal ring having an upper portion defining an upper surface, a lower surface and a first annular space;

a second seal ring having an upper portion defining an upper surface, a lower surface and a second annular space;

a first outside seal between said first seal ring and said second seal ring, said first outside seal for sealing engagement between said lower surface of said first seal ring and said upper surface of said second seal ring;

a first seal received within said first annular space, said first seal having an inner surface for engaging said rotating pipe;

a second seal received within said second annular space, said second seal having an inner surface for engaging said rotating pipe;

a lower ring between the lower connector pipe and a lowermost one of said first seal ring, said second seal ring, and said third seal ring;

wherein all of a surface of said lower ring facing said lowermost one is co-planar;

an outside seal between a lower surface of said lower ring and an upper surface of the lower connector pipe for sealing engagement between said lower surface of said lower ring and an upper surface of the lower connector pipe.

* * * * *